US005510697A

United States Patent [19]

Dormer

[11] Patent Number: 5,510,697

[45] Date of Patent: Apr. 23, 1996

[54] LOW DROP-OUT VOLTAGE REGULATOR APPARATUS

[75] Inventor: Michael W. Dormer, Basingstoke, Great Britain

[73] Assignee: VTECH Communications,Inc., Hong Kong

[21] Appl. No.: 252,344

[22] Filed: Jun. 1, 1994

[30] Foreign Application Priority Data

Jun. 2, 1993 [GB] United Kingdom ..... 9311300

[51] Int. Cl.[6] ..... G05F 1/40; G05F 1/44

[52] U.S. Cl. ..... 323/273; 323/274; 323/282

[58] Field of Search ..... 323/223, 226, 323/273, 274, 281, 282, 289, 312, 313

[56] References Cited

U.S. PATENT DOCUMENTS

| | | | |
|---|---|---|---|
| 3,916,294 | 10/1975 | Kennedy | 323/22 |
| 4,479,085 | 10/1984 | Uchida et al. | 323/280 |
| 4,543,522 | 9/1985 | Moreau | 323/303 |
| 4,560,918 | 12/1985 | Callen | 323/273 |
| 4,792,747 | 12/1988 | Schroeder | 323/303 |
| 4,928,056 | 5/1990 | Pease | 323/314 |
| 5,373,225 | 12/1994 | Poletto et al. | 323/282 |
| 5,453,678 | 9/1995 | Bertolini et al. | 323/282 |

FOREIGN PATENT DOCUMENTS

| | | | |
|---|---|---|---|
| 1126951 | 9/1968 | United Kingdom | G05F 1/58 |
| 1532844 | 11/1978 | United Kingdom | G05F 1/58 |
| WO8301351 | 4/1983 | WIPO | H02J 9/00 |

*Primary Examiner*—Matthew V. Nguyen
*Attorney, Agent, or Firm*—Dick and Harris

[57] ABSTRACT

A voltage regulator apparatus for regulating an unregulated voltage supply to in turn provide a regulated voltage. The voltage regulator apparatus includes a pass device, which has a control port, passes a portion of an unregulated voltage through to the regulated voltage output. The apparatus also includes a DC amplifier which provides a large closed loop gain to the regulated voltage output which is fed back to the pass device control port. The portion of the unregulated voltage passed to the regulated voltage output is a function of the output of the DC amplifier. The apparatus finally includes a voltage reference which provides a reference voltage to the DC amplifier. The DC amplifier voltage reference and pass device control port all draw the same operating current from the unregulated voltage supply. Thus, creating a sharp low-drop out characteristic for the voltage regulator apparatus.

11 Claims, 1 Drawing Sheet

LOW DROP-OUT VOLTAGE REGULATOR APPARATUS

BACKGROUND OF THE INVENTION

1. Field of the Invention

The present invention relates in general to a voltage regulator apparatus and, in particular, to a low-drop out voltage regulator apparatus with a sharp shut-off characteristic.

2. Background Art

Voltage regulators are well known in the art. Three-terminal voltage regulators accept an input voltage to produce a regulated output voltage which is held constant, as compared to ground, even during variation in the load. There are many different types of voltage regulators, for instance, there are low-power and low-dropout regulators. The term low-power is self-explanatory. Low-dropout regulators are voltage regulators which require less "headroom" than standard regulators. "Headroom" is the voltage measure required between unregulated and regulated voltage for operation, which for a standard regulator is 2 volts (or 3 base-emitter voltage drops). Low-dropout voltage regulators require approximately a half-volt headroom. Thus, low-dropout regulators are particularly useful in applications where rechargeable batteries are used. However, some of these regulators pull excessive quiescent current as they fall out of regulation. This excessive current draw causes a rechargeable battery to be deeply discharged—a highly undesirable condition.

It is thus an object of the present invention to provide a low-dropout voltage regulator which has a sharp cutoff as it begins to fall out of regulation, so as to prevent pulling an excessive quiescent current.

This and other objects will be become apparent in light of the attached specification and drawings.

SUMMARY OF THE INVENTION

A preferred embodiment of the invention comprises a voltage regulator apparatus for regulating an unregulated voltage to in turn provide a regulated voltage. The voltage regulator apparatus includes a pass device, controlled by a control port, which passes a portion of the unregulated voltage through to the regulated voltage output. The pass device may comprise a bipolar junction or field effect transistor or an electrical valve.

In a preferred embodiment, a voltage divider means—comprised of two resistors—is operably connected to the regulated voltage output for dividing the regulated voltage down to a voltage which is fed into a DC amplification means.

The voltage regulator apparatus further includes DC amplification means, for providing a large closed loop gain between the regulated voltage output and the pass device control port (which may comprise the base of a transistor where the pass device is a transistor). The portion of the unregulated voltage which is passed to the regulated voltage output is a function of the output of the DC amplification means.

The voltage regulator apparatus finally includes a voltage reference means which may comprise a band gap reference or zener diode, for providing a reference voltage to the DC amplification means. The DC amplification means, voltage reference means, and pass device control port all draw their operating current from the unregulated voltage supply. Thus, when the unregulated voltage drops below the desired regulated voltage, the apparatus immediately shuts off, so as not to over drain the unregulated voltage supply, which may comprise a rechargeable battery.

DETAILED DESCRIPTION OF THE DRAWINGS

Figure 1:
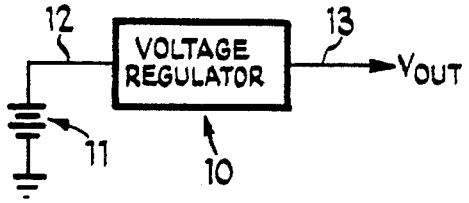
FIG. 1 of the drawings is a block diagram of the present voltage regulator apparatus showing, in particular, one potential use of the invention.

While this invention is susceptible of embodiment in many different forms and in many different systems, there is shown in the drawings and will herein be described in detail, one specific embodiment with the understanding that the present disclosure is to be considered as an exemplification of the principles of the invention and is not intended to limit the invention to the embodiment illustrated.

Figure 2:
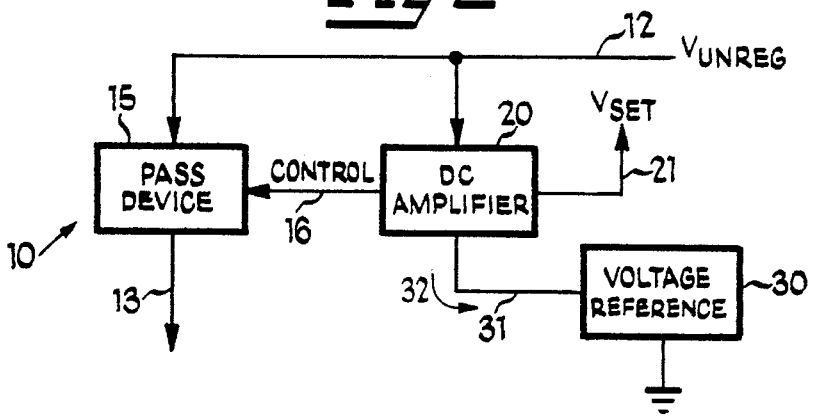
FIG. 2 of the drawings is a simplified block diagram of the voltage regulator apparatus.

Voltage regulator apparatus 10 is shown in FIG. 1 connected to variable power supply 11, which may comprise a rechargeable battery. This variable power supply 11 supplies unregulated voltage 12 to voltage regulator apparatus 10, which in turn provides regulated voltage output 13 for use in driving a load. As shown in FIG. 2, voltage regulator apparatus 10 comprises a pass device 15, DC amplification means 20 and voltage reference means 30.

Pass device 15, which may comprise any type of transistor or electrical valve, passes a portion of unregulated voltage 12 from variable power supply 11 through as regulated voltage output 13. Pass device 15 includes control port 16, which controls the output of pass device 15. In a preferred embodiment, where pass device 15 is a PNP bipolar junction transistor, control port 16 is the transistor's base; the pass device emitter is operably connected to variable voltage supply 11 and the pass device collector sources regulated voltage output 13. This configuration gives apparatus 10 its low drop out characteristic wherein the necessary "headroom" corresponds to the saturation voltage of pass device 15.

Figure 3:
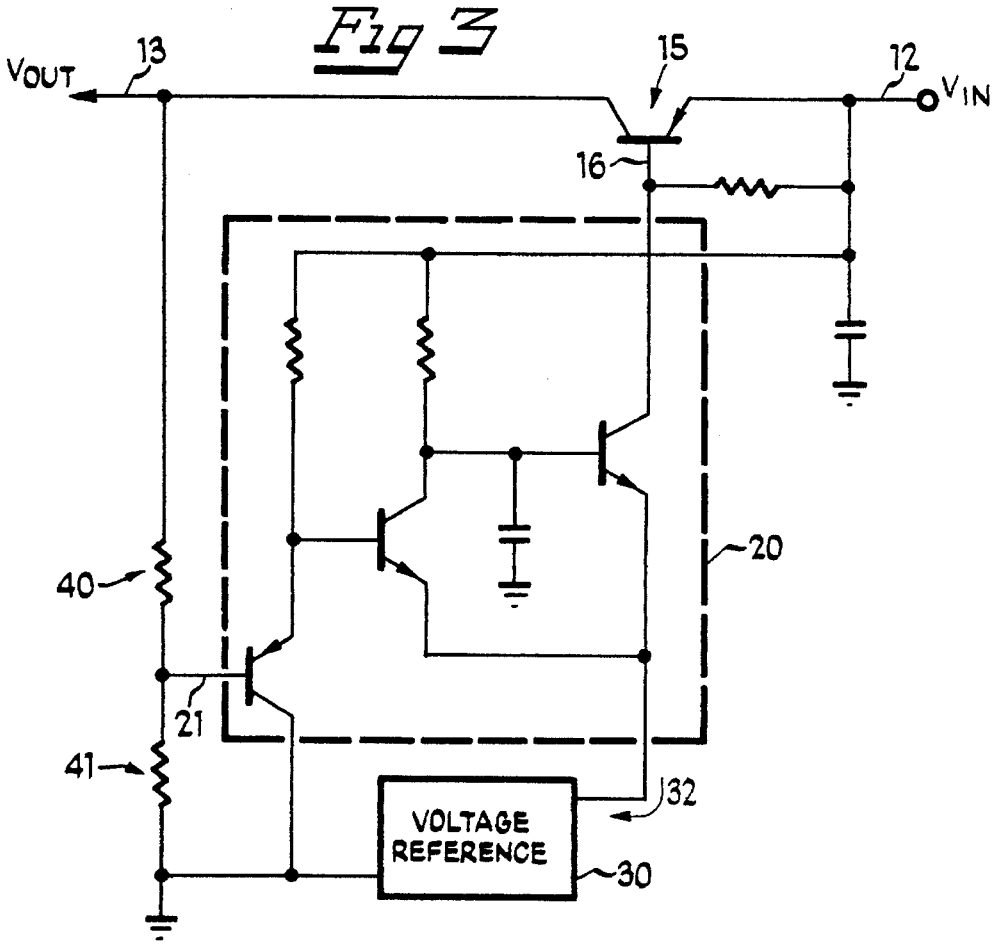
FIG. 3 of the drawings is a schematic block diagram of the voltage regulator apparatus.

DC amplification means 20 is operably connected to control port 16 of pass device 15 and receives feed back from regulated voltage output 13. DC amplification means 20 provides a large closed loop gain between regulated voltage output 13 and control port 16, such that pass device 15 may be properly controlled to provide the necessary portion of unregulated voltage 12 to be passed through pass device 15 as regulated voltage output 13 shown in FIG. 3. DC amplification means 20 may be any type of DC amplifier providing large close loop gain. In fact, as can be seen in FIG. 3, voltage regulator apparatus 10 can utilize a rather simple DC amplifier.

The feedback provided to DC amplification means 20 is $V_{set}$21. $V_{set}$21 is the output of voltage divider means which comprises resistors 40 and 41. Resistor 40 is operably connected to regulated voltage output 13 and thus $V_{set}$21 is a multiple of regulated voltage output 13, as is known in the art. In a preferred embodiment, the values of resistors 40 and 41 are chosen such that $V_{set}$21 is substantially equal to reference voltage 31.

Voltage reference means 30 is operably connected to DC amplification means 20 to provide reference voltage 31 to DC amplification means 20. Voltage reference means 30 is an active reference device, such as a band gap reference or zener diode, drawing its operating current from variable voltage supply 11 through DC amplification means 20. The value of reference voltage 31 depends upon the desired value of regulated voltage output 13. For instance, where a 5 volt regulated supply is desired, reference voltage 31 would be 4.3 volts. This, of course would require a 4.3 volt band gap reference or a zener diode with a zener voltage of 4.3 volts.

Voltage regulator apparatus 10 is configured such that DC amplifier means 20, pass device 15 and voltage reference means 30 are all in series and thus all draw their operating current from variable voltage supply 11. Thus, the DC amplification means operating current 32 provides reference voltage 31 by sourcing voltage reference means 30. Therefore, this configuration provides for a sharp cut off when unregulated voltage 12 from variable voltage supply 11 drops below the desired reference voltage.

Essentially, when unregulated voltage 12 is too low—5 volts in the above example—there is no operating current 32 because the voltage across voltage reference means 30 is insufficient to bias voltage reference means 30 and thus no current is drawn through DC amplification means 20 and pass device 15 thus sharply shutting off the draw from variable voltage supply 11. This sharp cut-off prevents deep discharging of variable voltage supply 11, which may comprise a rechargeable battery. This configuration further provides for the use of a simple DC amplifier design, such as the one in FIG. 3 of the drawings. Of course, an alternate, even more complicated DC amplifier may be used, including a DC amplifier designed around an operational amplifier, wherein $V_{set}$21 and reference voltage 31 are supplied as its inputs.

The foregoing description and drawings merely explain and illustrate the invention and the invention is not limited thereto, except insofar as the appended claims are so limited and as those skilled in the art who have the disclosure before them will be able to make modifications and variations therein without departing from the scope of the invention.

I claim:

1. A voltage regulator apparatus for regulating an unregulated voltage supply to in turn provide a regulated voltage, said voltage regulator apparatus comprising:

a pass device for passing a portion of said unregulated voltage supply through to said regulated voltage, said pass device having a control port;

DC amplification means for providing a large closed loop gain operably connected between said regulated voltage output and said control port, said portion of said unregulated voltage supply being passed to said regulated voltage output being a function of the output of said DC amplification means, as applied to said control port; and voltage reference means operably connected to said DC amplification means for providing a reference voltage to said DC amplification means;

said DC amplification means, voltage reference means, and control port being driven by the same operating current from the unregulated voltage supply whereby when the unregulated voltage falls below the desired regulated voltage said voltage reference means sharply shuts off, in turn, shutting off said DC amplification means and said pass device.

2. The invention according to claim 1 wherein said pass device comprises an electrical valve.

3. The invention according to claim 1 wherein said pass device comprises a bipolar junction transistor.

4. The invention according to claim 1 wherein said voltage reference means is a band gap reference device.

5. The invention according to claim 1 wherein said voltage reference means is a zener diode.

6. The invention according to claim 1 wherein said voltage regulator apparatus is of the type constructed of bipolar junction transistors.

7. The invention according to claim 1 wherein said voltage regulator apparatus is of the type constructed of electrical valves.

8. The invention according to claim 1 wherein said voltage regulator apparatus is of the type constructed of field effect transistors.

9. A low drop-out voltage regulator apparatus for regulating an unregulated voltage supply to provide, in turn, a regulated voltage output, said voltage regulator apparatus comprising:

a first transistor having a first emitter, a first collector, and a first base, said first emitter being operably connected to said unregulated voltage supply, said first collector sourcing said regulator voltage output;

voltage divider means operably connected to said first collector for dividing said regulated voltage output into a setting voltage;

DC amplification means for providing a large closed loop gain, said DC amplification means operably receiving said setting voltage from said voltage divider means and providing an output to said first base of said first transistor; and voltage reference means operably connected to said DC amplification means for providing a reference voltage to said DC amplification means;

said first base, DC amplification means and voltage reference means being in series and thus drawing the same operating current from the unregulated voltage supply whereby when the unregulated voltage falls below the desired regulated voltage said voltage reference means sharply shuts off, in turn, shutting off said DC amplification means and said first transistor.

10. The invention according to claim 9 wherein said voltage reference means is a band gap reference.

11. The invention according to claim 9 wherein said voltage reference means is a zener diode.

* * * * *